US005210574A

United States Patent [19]

Kita

[11] Patent Number: 5,210,574

[45] Date of Patent: May 11, 1993

[54] PHOTOSENSITIVE DRUM BODY-MOUNTING MECHANISM INCLUDING A DRIVE COUPLING MEMBER WITH A COUPLING PROTRUSION ADAPTED TO BITE INTO THE INNER SURFACE OF THE MECHANISM'S PHOTOSENSITIVE DRUM

[75] Inventor: Hideki Kita, Suita, Japan

[73] Assignee: Mita Industrial Co., Ltd., Japan

[21] Appl. No.: 843,256

[22] Filed: Feb. 28, 1992

[30] Foreign Application Priority Data

Mar. 8, 1991 [JP] Japan ..... 3-67647
Mar. 8, 1991 [JP] Japan ..... 3-67648

[51] Int. Cl.[5] ..... G03G 15/00
[52] U.S. Cl. ..... 355/211; 355/210
[58] Field of Search ..... 355/299, 271, 272, 273, 355/274, 210, 211

[56] References Cited

U.S. PATENT DOCUMENTS 4,211,484 7/1980 Iwai et al. .
4,839,690 6/1989 Onoda et al. ..... 355/211
4,935,778 6/1990 Mochida ..... 355/211
4,975,743 12/1990 Surti ..... 355/211
4,975,744 12/1990 Ebata et al. ..... 355/211
5,053,817 10/1991 Ogiri et al. ..... 355/211

*Primary Examiner*—R. L. Moses
*Attorney, Agent, or Firm*—Beveridge, DeGrandi & Weilacher

[57] ABSTRACT

An image-forming machine includes a photosensitive drum on which a toner image is to be formed on the peripheral surface thereof, a transfer drum onto which is removably fitted an image-forming sheet member onto which said toner image will be transferred, and a cleaning device that removes the toner remaining on the peripheral surface of the photosensitive drum after the transfer of image has been finished. The image-forming area on the peripheral surface of the photosensitive drum is defined inside the portions that correspond to both side edges of the transfer sheet member of the transfer drum. A cleaning blade in the cleaning device is present continuously over the image-forming area but does not extend up to portions that correspond to both side edges of the transfer sheet. The photosensitive drum includes a pair of flange members and a photosensitive drum body mounted to the flange members. A drive coupling member made of a resilient metal is secured to one of the flange members, and has a coupling protrusion that bites into the inner surface of the photosensitive drum body.

6 Claims, 6 Drawing Sheets

PHOTOSENSITIVE DRUM BODY-MOUNTING MECHANISM INCLUDING A DRIVE COUPLING MEMBER WITH A COUPLING PROTRUSION ADAPTED TO BITE INTO THE INNER SURFACE OF THE MECHANISM'S PHOTOSENSITIVE DRUM

FIELD OF THE INVENTION

The present invention relates to an image-forming machine equipped with a photosensitive drum, and particularly to an image-forming machine of a type equipped with a photosensitive drum and a transfer drum in which a toner image is formed on a photosensitive material disposed on the peripheral surface of the photosensitive drum and is transferred onto an image-forming sheet member that is removably fitted onto the peripheral surface of the transfer drum.

DESCRIPTION OF THE PRIOR ART

In an image-forming machine such as a multi-color copier or a multi-color laser beam printer, a photosensitive drum is rotatably disposed and a transfer drum, too, is rotatably disposed as is well known. A photosensitive material is set on the peripheral surface of the photosensitive drum., and a toner image is formed on the photosensitive material by a known system while the photosensitive drum is rotated in a predetermined direction. The transfer drum includes a pair of flange members fitted on its both side edges and a transfer sheet member. The transfer sheet member which is preferably made of a soft synthetic resin sheet covers the peripheral surfaces of the pair of flange members at both side edges. The transfer drum is rotatably mounted and is allowed to move between an acting position and a non-acting position. An image-forming sheet member which may be an ordinary sheet of paper is removably fitted onto the transfer sheet member of the transfer drum. The toner image formed on the photosensitive material is transferred onto the image-forming sheet member fitted onto the transfer drum. In this case the transfer drum is located at the acting position so that the surface of the image-forming sheet member comes in intimate contact with the peripheral surface of the photosensitive drum. The photosensitive drum and the transfer drum are rotated in synchronism with each other. An output gear is disposed at one side edge of the photosensitive drum and an input gear is disposed at one side edge of the transfer drum both gears being engaged with each other. The rotation of the photosensitive drum that is driven is transmitted to the transfer drum via the output gear and input gear. A cleaning means is arranged in relation to the photosensitive drum to remove the toner that remains on the peripheral surface of the photosensitive drum after the image has been transferred. The cleaning means includes a cleaning blade made of a synthetic rubber and the tip of the cleaning blade is brought into contact with the peripheral surface of the photosensitive drum. When a multi-color image is to be formed on the image-forming sheet member, formation and transfer of the toner image are executed for each of a plurality of colors.

In the image-forming machine of the type mentioned above, it is important that the toner images of the plurality of colors are transferred to required portions of the image-forming sheet member without deviated relative to one another. For this purpose, it is important that the transfer drum is rotated in sufficiently precise synchronism with the rotation of the photosensitive drum at the time of transfer of image. A so-called backlash is inevitably involved in the engagement of gears, and synchronous rotation of the photosensitive drum and the transfer drum cannot be relied solely upon the engagement of the output gear and the input gear. In the conventional image-forming machine, therefore., both side edges of peripheral surface of the transfer drum (the transfer sheet covers peripheral surfaces of flange members at both side edges) are brought into contact with both side edges of the photosensitive drum when the transfer drum is brought to the acting position, so that relative positions of the photosensitive drum and the transfer drum, i.e. relative positions of the output gear and the input gear are defined as required. Thus, the rotary drum rotates in sufficiently precise synchronism with the rotation of the photosensitive drum as required. (However, the central region of peripheral surface of the transfer drum must be sufficiently soft to follow a change in the thickness of the image-forming sheet member that is placed thereon and hence, it is not possible to sufficiently precisely define a relationship between the photosensitive drum and the transfer drum by bringing the central region of peripheral surface of the transfer drum into contact with the central region of peripheral surface of the photosensitive drum via the image-forming sheet material mounted thereon).

Therefore, the conventional image-forming machine equipped with both the photosensitive drum and the transfer drum have the following problems that must be solved. When both side edges of peripheral surface of the transfer drum are brought in contact with both side edges of peripheral surface of the photosensitive drum, the photosensitive material is inevitably damaged at both sides of peripheral surface of the photosensitive drum after repeated use. In general both side edges of peripheral surface of the photosensitive drum are not used for forming the toner image and therefore, formation of the toner image is not directly suffered from adverse effect when both side edges of peripheral surface of the photosensitive drum are damaged. When both side edges of peripheral surface of the photosensitive drum are damaged however the toner that scatters at the time of developing tends to stay on the damaged portions. With the toner staying, the cleaning blade that is in contact with the peripheral surface of the photosensitive drum at both side edges receives locally excessive force at portions where the toner is staying. Therefore, the cleaning blade is distorted not only at both side edge portions but also at the central portion, so that the cleaning performance is greatly deteriorated to adversely affect the formation of toner image.

In order to prevent both side edges of peripheral surface of the photosensitive drum from being damaged it has already been proposed and put into practice to fit a buffer piece made of a soft material such as synthetic rubber of felt to both side edges of peripheral surface of the transfer drum and bring the peripheral surface of the transfer drum into contact with the peripheral surface of the photosensitive drum via the buffer pieces. When such buffer pieces are used, however, considerable error develops at the relative positions of the photosensitive drum and the transfer drum due to the hardness or different in the thickness of the buffer pieces when the peripheral surface of the transfer drum and the peripheral surface of the photosensitive drum are brought into contact with each other via buffer pieces, and error further develops in the synchronous rotation of the photosensitive drum and the transfer drum.

Moreover, not only in the image-forming machine of the form having photosensitive drum and transfer drum but also in the image-forming machines of a variety of types having photosensitive drum, it is important that the photosensitive drum is rotated as required and is detachably mounted so that the photosensitive material can be cleaned when it is contaminated or the photosensitive drum body can be renewed when the photosensitive material is deteriorated. It is further important to ground the rotary drum body made of an electrically conductive material via a suitable means.

In a typical example of a photosensitive drum body-mounting mechanism, a stationary support shaft is secured to a predetermined position in the image-forming machine, a pair of flange members are rotatably mounted on the support shaft at a distance in the axial direction, and the photosensitive drum body is mounted to the pair of flange members so as to rotate together therewith. One of the pair of flange members is drivably coupled to a rotational drive source which may be an electric motor via a transmission means such as a transmission gear, and is rotated in a predetermined direction by the drive source. In order that the rotation of the flange member that is driven is reliably transmitted to the photosensitive drum body to rotate the photosensitive drum body together with the flange members, Japanese Utility Model Laid-Open Publication No. 176873/1987 discloses an art according to which a notch is formed at one end of the photosensitive drum body, a protuberance that comes into engagement with the notch is formed on the flange members, and the rotation of the flange members is transmitted to the photosensitive drum body owing to the notch and protuberance that work in cooperation together. The photosensitive drum body is generally made of aluminum and the inner peripheral surface of the drum is coated with an oxide film. In this case, since the oxide film applied to the inner peripheral surface of the photosensitive drum body is electrically nonconductive the film is locally removed permitting the electrically conductive aluminum to be exposed, and one end of an electric connection wire is fastened to the exposed portion to ground the photosensitive drum body.

According to the transmission method disclosed in the above Japanese Utility Model Laid-Open Publication No. 176873/1987, however it is necessary to form a notch at one end of the photosensitive drum through an additional mechanical work. This involves the following problems that must be solved. That is (a) an increase in the manufacturing cost is caused by the additional mechanical work, (b) deformation of the photosensitive drum body is caused by the additional mechanical work. i.e. the circularity is decreased which adversely affects the image formed on the photosensitive material.

According to the above-mentioned conventional electric connection method, furthermore, it becomes necessary to locally remove the electrically nonconductive film from the inner peripheral surface of the photosensitive drum body resulting in an increase in the number of manufacturing steps and, hence, in the manufacturing cost.

SUMMARY OF THE INVENTION

A first object of the present invention is to provide an image-forming machine equipped with a photosensitive drum and a transfer drum, which is so improved that the cleaning performance is not impaired even when both side edges of peripheral surface of the photosensitive drum are damaged and that formation and transfer of toner image of good quality can be carried out for extended period of time.

A second object of the present invention is to improve a photosensitive drum body-mounting mechanism in an image-forming machine without an increase in the manufacturing cost, so that the photosensitive drum body will be free from undesirable deformation and the rotation of the flange members that are driven is reliably transmitted to the photosensitive drum body.

A further object of the present invention is to provide an improved photosensitive drum body-mounting mechanism which enables the photosensitive drum body to be grounded even when an electrically nonconductive film is formed on the inner peripheral surface of the photosensitive drum, without the need of locally removing the electrically nonconductive film.

In order to achieve the above first object according to the present invention, both side edges of peripheral surface of the transfer drum i.e. both side edges of the transfer sheet member, are brought into direct contact with both side edges of peripheral surface of the photosensitive drum without help of any buffer piece, the image-forming area on the peripheral surface of the photosensitive drum is defined inside both side edges to which both side edges of peripheral surface of the transfer drum are brought into contact, and the cleaning blade of the cleaning means is brought into contact with the peripheral surface of the photosensitive drum, extending over the image-forming area but without extending to both side edges to which the transfer sheet member is brought in contact.

That is, according to the present invention there is provided an image-forming machine comprising a photosensitive drum that is rotatably mounted, a transfer drum that is rotatably mounted and is allowed to selectively move between an acting position at which the peripheral surface thereof partly comes into contact with the peripheral surface of said photosensitive drum and a nonacting position at which the peripheral surface thereof is separated away from the peripheral surface of said photosensitive drum, and a cleaning means, and in which a photosensitive material is disposed on the peripheral surface of said photosensitive drum, said transfer drum includes a pair of flange members disposed at both side edges thereof and a transfer sheet member of which both side edges cover the peripheral surfaces of said pair of flange members, said cleaning means includes a cleaning blade that extends in the axial direction of said photosensitive drum and comes at the tip thereof in contact with the peripheral surface of said photosensitive drum, a rotary output means is secured to one side edge of said photosensitive drum, a rotary input means is secured to one side edge of said transfer drum to come into engagement with said rotary output means, the rotation of said photosensitive drum is transmitted to said transfer drum via said rotary output means and said rotary input means, a toner image is formed on the image-forming area on the peripheral surface of said rotary drum, an image-forming sheet member is removably fitted onto a transfer area that is defined on the peripheral surface of said transfer drum inside said flange members, the toner image formed on the peripheral surface of said photosensitive drum is transferred onto the image-forming sheet member fitted onto the peripheral surface of said transfer drum, and a toner remaining on the peripheral surface of said photosensitive drum after the transfer of image is removed from the peripheral surface of said photosensitive drum by said cleaning means, the improvement wherein when said transfer drum is located to said acting position, both side edges of said transfer sheet member of said transfer drum, that cover the peripheral surfaces of said pair of flange members, are brought into direct contact with both side edges of the peripheral surface of said photosensitive drum, said image-forming area on the peripheral surface of said photosensitive drum is defined inside both side edges with which said transfer sheet is brought into contact, and said cleaning blade in said cleaning means is brought into contact with the peripheral surface of said photosensitive drum extending continuously over said image-forming area but without extending to said both side edges with which said transfer sheet member is brought into contact.

Desirably, said cleaning means is provided with a pair of sealing pieces that are brought in contact with both side edges of peripheral surface of the photosensitive drum. The sealing pieces may be piled sheet pieces.

In the image-forming machine of the present invention, the cleaning blade is not extending to both side edges of the peripheral surface of the photosensitive drum. Therefore, even in case both side edges of peripheral surface of the photosensitive drum are damaged and the toner stays on the damaged portions, the cleaning blade does not act on the toner staying on the damaged portions; i.e., the cleaning blade is not distorted and the cleaning performance is not deteriorated.

The toner staying on the damaged portions at both side edges of peripheral surface of the photosensitive drum is partly removed and is prevented from scattering around by the action of a pair of sealing members that are constituted separately from the cleaning blade and that are in contact with both side edges of peripheral surface of the photosensitive drum.

In order to achieve the above second object according to the present invention, drive coupling members made of a resilient metal and having a coupling protrusion are secured to the flange member, the coupling protrusion of the drive coupling member is so disposed as to define an acute angle relative to the inner peripheral surface of the photosensitive drum body on the upstream side as viewed in the direction of rotation of the flange members, and the tip of the coupling protrusion is pressed onto the inner peripheral surface of the photosensitive drum body, so that when the flange members are rotated, the tip of the coupling protrusion of the drive coupling member bites into the inner peripheral surface of the photosensitive drum body causing the photosensitive drum body and the flange members to rotate together.

In order to achieve the above further object according to the present invention, the photosensitive drum body made of an electrically conductive material is grounded via the drive coupling member that has a coupling protrusion of which the tip bites into the inner peripheral surface of the photosensitive drum body to break the electrically nonconductive film.

That is, according to the present invention, there is provided a photosensitive drum body-mounting mechanism in an image-forming machine in which a cylindrical photosensitive drum body having a photosensitive material set on the peripheral surface thereof is detachably mounted to the flange members that rotate in a predetermined direction, to be rotated together with said flange members wherein a drive coupling member made of a resilient metal and having a coupling protrusion is secured to said flange members, said coupling protrusion of said drive coupling member defines an acute angle relative to the inner peripheral surface of the photosensitive drum body on the upstream side as viewed in the direction of rotation of the flange members and the tip of the coupling protrusion is pressed onto the inner peripheral surface of the photosensitive drum body, so that when the flange members are rotated, the tip of the coupling protrusion bites into the inner peripheral surface of the photosensitive drum body causing the photosensitive drum body and the flange members to rotate together.

It is desired that the drive coupling member is made of a spring steel and that a sharp vertex is formed at the tip of the coupling protrusion thereof.

In the photosensitive drum body-mounting mechanism of the present invention for achieving the above further object of the present invention, the photosensitive drum body is made of an electrically conductive material and is grounded via the drive coupling member. The flange members are rotatably mounted on a stationary support shaft a cylindrical connection member made of an electrically conductive material is fitted onto the stationary support shaft the drive coupling member has a connection protrusion pressed onto the outer peripheral surface of the connection member, and the photosensitive drum body is grounded via the drive coupling member and the connection member.

Desirably furthermore a pair of flange members are rotatably mounted on the stationary support shaft, each of the pair of flange members has a cylindrical support peripheral surface to which the photosensitive drum body is fitted and an annular receiving surface that outwardly extends in the radial direction from the outer edge in the axial direction of the support peripheral surface, a drive coupling member is secured to one of the flange members on the inside in the axial direction, the other flange member is movably mounted in the axial direction, a resilient urging means is disposed to resiliently urged the other flange member inwards in the axial direction, and the receiving surface of the other flange member is pressed onto one edge of the photosensitive drum body by the resiliently urging action of the resilient urging means and the other edge of the photosensitive drum body is pressed onto the receiving surface of said one flange member.

In the photosensitive drum body-mounting mechanism of the present invention, rotation of the flange members is reliably transmitted to the photosensitive drum body by the action of the drive coupling member secured to the flange members. The drive coupling member can be constituted very simply and be made at a low cost, and hence, does not cause the manufacturing cost to increase. The photosensitive drum itself requires no additional mechanical work, and is not undesirably deformed.

In the photosensitive drum body-mounting mechanism of the present invention furthermore, the tip of coupling protrusion of the drive coupling member bites into the inner peripheral surface of the photosensitive drum body and an electrically nonconductive film that is formed on the inner peripheral surface of the photosensitive drum body is broken. Therefore, even when the electrically nonconductive film exists on the inner peripheral surface of the photosensitive drum body it is allowed to ground the photosensitive drum body via the drive coupling member without the need of locally removing the film.

DETAILED DESCRIPTION OF PREFERRED EMBODIMENTS

A preferred embodiment of the image-forming machine constituted according to the present invention will be described in further detail by reference to the accompanying drawings.

Figure 1:
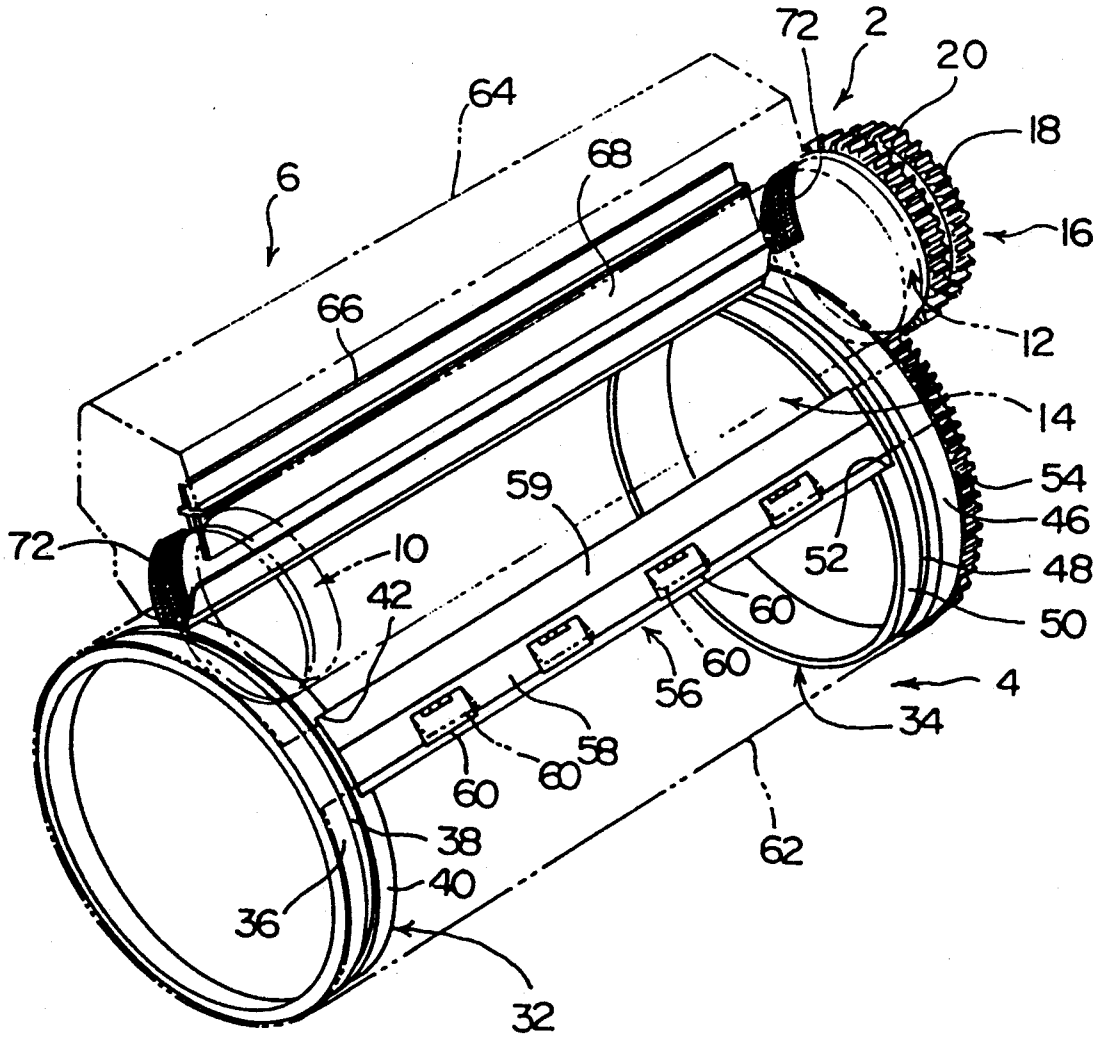
FIG. 1 is a perspective view illustrating major constituent elements of an improved image-forming machine according to a preferred embodiment of the present invention.
Figure 2:
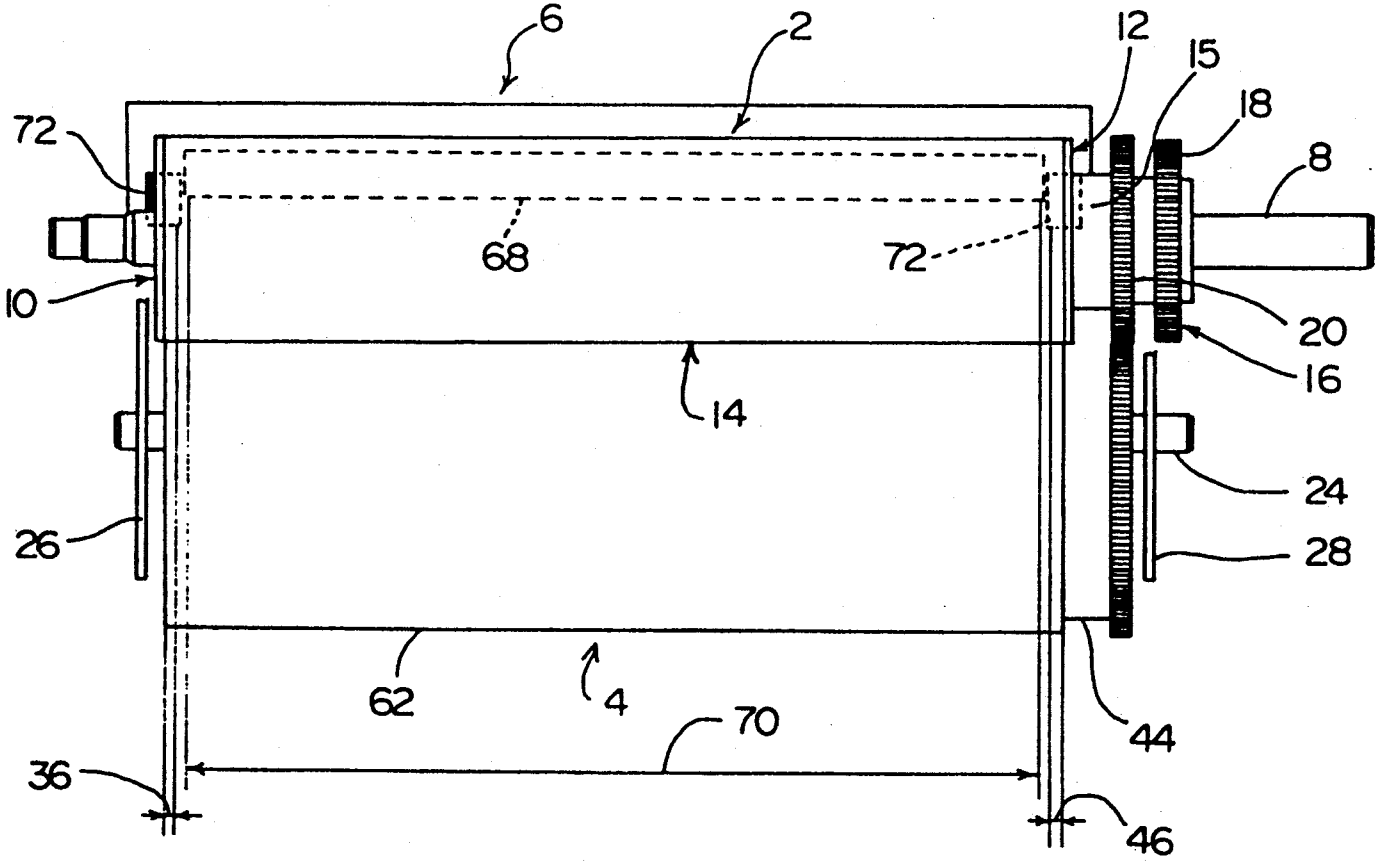
FIG. 2 is a side view illustrating major constituent elements in the image-forming machine of FIG. 1.
Figure 3:
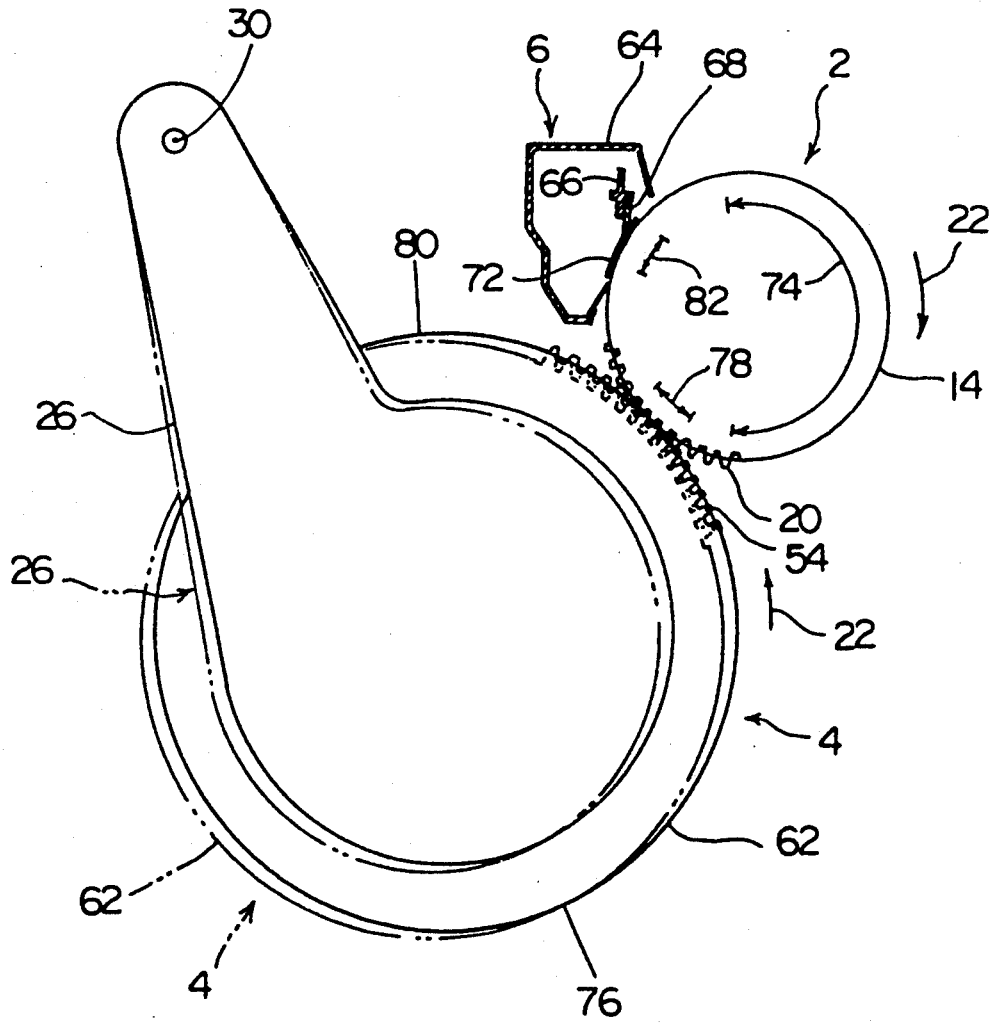
FIG. 3 is a sectional view illustrating major constituent elements in the image-forming machine of FIG. 1.

With reference to FIGS. 1, 2 and 3, the illustrated multi-color image-forming machine is provided with a photosensitive drum 2, a transfer drum 4, and a cleaning means 6. The photosensitive drum 2 includes a stationary support shaft 8 secured to a required position. Flange members 10 and 12 of the front side and the rear side are rotatably mounted on the support shaft 8 that extends substantially horizontally, at a distance in the axial direction, and a photosensitive drum body 14 of a cylindrical shape is mounted between the flange members 10 and 12. A suitable photosensitive material is set on the peripheral surface of the photosensitive drum body 14. A cylindrical protuberance 15 is formed on the flange member 12 of the rear side to outwardly protrude in the axial direction and a gear member 16 is secured to the protuberance 15. The gear member 16 includes a gear 18 that constitutes a rotary input means and a gear 20 that constitutes a rotary output means. The gear 18 is drivably coupled to a driving source (not shown) which may be an electric motor via a suitable transmission gear train (not shown), and the flange members 10, 12 and the photosensitive drum body 14 are rotated by the driving source in a direction indicated by arrow 22 in FIG. 3. A mechanism for mounting the photosensitive drum body 14 will be described later in detail.

The transfer drum 4 includes a support shaft 24 which extends substantially in parallel with the above support shaft 8 of the photosensitive drum 2. In the image-forming machine as will be understood by reference to FIGS. 2 and 3, a pair of support members 26 and 28 are arranged at a distance in the axial direction and the support shaft 24 is secured to the support members 26 and 28. Here, the support members 26 and 28 are swingably mounted to swing on a swing axis 30 that extends substantially in parallel with the support shaft 24, and are selectively positioned at the acting position indicated by a solid line in FIGS. 2 and 3 and at the non-acting position indicated by a two-dot chain line in FIG. 3 by a suitable swing mechanism (not shown) that can be constituted by an electromagnetic solenoid. Flange members 32 and 34 of the front side and rear side are rotatably mounted on the support shaft 24 via a bearing means (not shown). Chiefly referring to FIG. 1, the flange member 32 of the front side is nearly of a cylindrical shape and has a cylindrical support portion 36 an annular groove portion 38 and a cylindrical coupling portion 40 that are located in the order from the outside toward the inside in the axial direction. The peripheral surface of the support portion 36 has a predetermined outside diameter D1, the peripheral surface of the groove portion 38 has an outside diameter D2 slightly smaller than the diameter D1, and the coupling portion 40 has an outside diameter D3 which is slightly greater than the outside diameter D2 but is slightly smaller than the outside diameter D1. A notch 42 is formed in the coupling portion 40 over a predetermined angle. The flange member 34 of the rear side is also nearly of a cylindrical shape and has a cylindrical protuberance 44 (FIG. 2). a cylindrical support portion 46, an annular groove portion 48 and a cylindrical coupling portion 50 that are located in the order from the outside toward the inside in the axial direction The outside diameter D1 of the support portion 46, outside diameter D2 of the groove portion, and outside diameter D3 of the coupling portion 50 are, respectively the same as the outside diameter D1 of support portion 36 outer diameter D2 of the groove portion 38 and outer diameter D3 of the coupling portion 40 of the flange member 32 of the front side. The outside diameter D4 of the protuberance 44 is slightly smaller than the outside diameter D2 of the groove portion 48. A notch 52 that corresponds to the above notch 42 is formed in the coupling portion 50 over a predetermined angle. A gear 54 is secured to the protuberance 44. The gear 54 constituting the rotary input means is brought into engagement with the gear 20 of the photosensitive drum 2 and rotation of the photosensitive drum 2 is transmitted to the transfer drum 4 via gears 20 and 54 (this will be referred to later). A stay member 56 is secured between the pair of flange members 32 and 34. One end of the stay member 56 extending in the axial direction is positioned in the notch 42 formed in the coupling portion 40 of flange member 32, and is secured to the coupling portion 40 by a suitable coupling means (not shown). The other end of the stay member 56 is positioned in the notch 52 formed in the coupling portion 50 of flange member 34 and is secured to the coupling portion 50 by a suitable coupling means (not shown). The stay member 56 has an upstream portion 58 located on the upstream side as viewed in the direction of rotation indicated by arrow 22 and a downstream portion 59 that extends toward the downstream side with the tilt at some angle with respect to the upstream portion 58. The surfaces of the stay member 56 are slightly lower than the peripheral surfaces of support portions 36 and 46 of the flange members 32 and 34. Four holding pieces 60 are arranged on the upstream portion 58 of the stay member 56 at intervals. The holding pieces 60 are mounted to swing between a holding position indicated by a solid line in FIG. 1 and a release position indicated by a two-dot chain line in FIG. 1, and are selectively located at a holding position and a release position by a suitable action means (not shown) that includes a cam mechanism set on the support shaft 24 (this will be described later). A transfer sheet member 62 is fitted onto the transfer drum 4. The transfer sheet member 62 is stuck at its one end to the upstream position 58 of the stay member 56 or, more specifically to a portion more on the upstream side than the holding pieces 60 on the upstream portion 58, and is wound around in the direction of rotation indicated by arrow 22 starting from the above end portion and is further stuck at its other end to the downstream portion 59 of the stay member 56, Both side edges of the transfer sheet member 62 tightly cover the peripheral surfaces of support portions 36 and 46 of the flange members 32 and 34 respectively. Desirably the transfer sheet member 62 is constituted by a soft synthetic resin sheet such as a polyethylene terephthalate sheet having a thickness of about 100 μm.

When the support members 26 and 28 of the transfer drum 4 are located at the acting position indicated by a solid line as will be understood by reference to FIGS. 1 and 3, the peripheral surfaces of support portions 36 and 46 of flange members 32 and 34 of the transfer drum 4 are brought into contact with the peripheral surface of photosensitive drum body 14 of the photosensitive drum 2 via the transfer sheet member 62. In other words, both side edges of the transfer sheet member 62 which cover the support portions 36 and 46 of flange member 32 and 34 are brought into contact with the peripheral surface of the photosensitive drum body 14. The outside diameters D2 and D3 of groove portions 38 and 48 and of coupling portions 40 and 50 of flange members 32 and 34 are slightly smaller than the outside diameter D1 of the support portions 36 and 46 and the surface of the stay member 56 is slightly lower than the peripheral surfaces of support portions 36 and 46 of flange members 32 and 34. Therefore there exists a small gap between the transfer sheet member 62 and the peripheral surface of the photosensitive drum body 14 except the portions of both side edges of the transfer sheet member 62. The outside diameter of both side edges of transfer sheet member 62 on the transfer drum 4 is equal to the diameter of a pitch circle of the gear 54, and the outside diameter of peripheral surface of the photosensitive drum body 14 is equal to the diameter of a pitch circle of the gear 20. When the transfer drum 4 is located at the acting position, therefore, the gear 20 of the photosensitive drum 2 is brought into engagement with the gear 54 of the transfer drum 4 (contacted to each other on the pitch circles) as desired, and rotation of the photosensitive drum body 14 is transmitted to the transfer drum 4 sufficiently precisely as desired. When the support members 26 and 28 of the transfer drum 4 are located at the non-acting position indicated by a two-dot chain line in FIG. 3, the transfer sheet member 62 is entirely separated away from the photosensitive drum body 14. As shown in FIG. 3, on the other hand the gear 20 and the gear 54 are not separated from each other but remain in engagement with each other while accompanied by the so-called backlash and rotation of the photosensitive drum body 14 continues to be transmitted to the transfer drum 4.

The cleaning means 6 will be described by reference to FIGS. 1, 2 and 3. The illustrated cleaning means 6 includes a housing 64 which is open on the entire surface that is faced to the photosensitive drum 2. In the housing 64 is disposed a support member 66 extending in the axial direction of the photosensitive drum 2, and a cleaning blade 68 is mounted on the support member 66. The cleaning blade 68 which can be made of a suitable synthetic rubber such as urethane rubber has the shape of a plate that extends slenderly in the axial direction of the photosensitive drum 2 and the tip of the blade is brought into contact with the peripheral surface of the photosensitive drum body 14.

Description will be further made by reference to FIGS. 1 and 2. In the image-forming machine constituted according to the present invention, it is important to define the area used for forming image on the peripheral surface of the photosensitive drum body 14 of photosensitive drum 2 i.e., to define an image-forming area 70 on the inside in the axial direction of both side edges of the transfer sheet member 62 on the transfer drum 4 (i.e. on the inside in the axial direction of portions covering the support portions 36 and 46 of the flange members 26 and 28). In the illustrated embodiment both side edges of image-forming area 70 on the peripheral surface of the photosensitive drum body 14 is located slightly inside from inner edges of support portions 36 and 46 of flange members 32 and 34 of the transfer drum 4. In the image-forming machine constituted according to the present invention furthermore, what is important is that the cleaning blade 68 in the cleaning means 6 extends continuously over the image-forming area 70 on the peripheral surface of the photosensitive drum body 14 but does not extend up to both side edges of the transfer sheet member 62 on the transfer drum 4. In the illustrated embodiment, both edges of the cleaning blade 68 are located which are slightly on the outside of both edges of the image-forming area 70 but are slightly on the inside of inner edges of support portions 36 and 46 of the flange members 32 and 34 of the transfer drum 4. In the illustrated cleaning means 6, seal pieces 72 are stuck to the front surface of housing 64 on both outer sides in the axial direction of the cleaning blade 68. The seal pieces 72 are brought into contact with the peripheral surface of the photosensitive drum body 14 on both outer sides of the image-forming area 70. The sealing pieces 72 may desirably be made of piled sheet pieces such as acrylic piled sheet pieces. If desired, the seal pieces 72 may be made of a sponge. Instead of providing seal pieces 72 on both outer sides of the cleaning blade 68. It is also allowable to fit additional blades that are coupled to the cleaning blade as a unitary structure via notches. In this case, it is important that the notches reliably prevent distortion produced in the additional blade from being transmitted to the cleaning blade so that distortion does not occur in the cleaning blade. If desired, the additional blades may be formed separately from the cleaning blade.

In the illustrated image-forming machine, an electrostatic latent image is formed on the image-forming area 70 of the peripheral surface of the photosensitive drum body 14 by a suitable electrostatic latent image-forming means (not shown) in an image-forming zone designated at 74 in FIG. 3, and the electrostatic latent image is developed into a toner image of a desired color by a suitable developing means (not shown). In the transfer drum 4, on the other hand, the leading edge of the image-forming sheet member which may be a common paper fed by a suitable feeding means (not shown) is held by the holding pieces 60 set on the stay member 56 in a holding zone designated at 76 in FIG. 3. That is, the leading edge of the image-forming sheet member is inserted between the upstream end of the stay member 56 and the holding pieces 60 at a releasing position indicated by a two-dot chain line in FIG. 1 and, then, the holding pieces 60 are turned to a holding position indicated by a solid line, so that the leading edge of the image-forming sheet member is held. The image-forming sheet member is wound on the transfer sheet member 62 on an area inside both side edges of the transfer sheet member 62 (i.e., on an area inside the portions that cover the support portions 36 and 46 of flange members 32 and 34). In a transfer zone designated at 78 in FIG. 3 the toner image formed on the peripheral surface of the photosensitive drum body 14 is transferred onto the image-forming sheet member fitted onto the transfer drum 4. During the transfer operation, the transfer drum 4 is located at the acting position indicated by solid line in FIG. 3 where rotation of the photosensitive drum body 14 is transmitted to the transfer drum 4 as mentioned earlier and the image-forming sheet member is rotated in very precise synchronism with the rotation of the photosensitive drum body 14. When a multi-color image is to be formed on the image-forming sheet member, formation and transfer of the toner image that are described above are repeated for a plurality of colors. During a period of from when the transfer of toner image of a given color is finished until when the transfer of toner image of a next color is started, the transfer drum 4 is located at the non-acting position indicated by a two-dot chain line in FIG. 3. When the desired image has been formed on the image-forming sheet member the holding pieces 60 are turned to the releasing position in a releasing zone designated at 80 in FIG. 3, and the image-forming sheet member is separated from the transfer drum 4 and is carried through a toner image-fixing means (not shown). In a cleaning zone designated at 82 in FIG. 3, on the other hand, the toner remaining on the peripheral surface of the photosensitive drum body 14 after the transfer of toner image is removed by the cleaning blade 68 which acts on the image-forming area 70 on the peripheral surface of the photosensitive drum body 14.

During the transfer of image, both side edges of the transfer sheet member 62 on the transfer drum 4, i.e. the portions covering the support portions 36 and 46 of the flange members 32 and 34 are brought into contact with both side edges of peripheral surface of the photosensitive drum body 14. As the transfer of image is repeated, therefore, both side edges of peripheral surface of the photosensitive drum body 14 might be damaged. Here, however, since both side edges of peripheral surface of the photosensitive drum body 14 are not used for forming the image, the toner image formed on the image-forming area 70 of the photosensitive drum body 14 does not suffer from the direct adverse effect due to such damage. When both side edges of peripheral surface of the photosensitive drum body 14 are damaged, on the other hand the toner scattered at the time of developing electrostatic latent image tends to stay on the damaged portions. In the conventional image-forming machine the cleaning blade acts directly onto both side edges of peripheral surface of the photosensitive drum body. Therefore, excess stress is exerted locally in the cleaning blade due to the toner staying on the damaged portions and hence, distortion occurs not only in both side edges of the cleaning blade but also in the central portion thereof, causing the cleaning performance to be deteriorated even on the image-forming area of the peripheral surface of the photosensitive drum body. In the image-forming machine constituted according to the present invention, on the other hand, the cleaning blade 68 does not extend up to both side edges that are to be damaged of the photosensitive drum body 14. Therefore, the cleaning blade 68 is undesirably not distorted by the toner that remains on the damaged portions and the cleaning performance is not deteriorated but is maintained under favorable condition. The seal pieces 72 that are provided separately from the cleaning blade 68 act upon both side edges of peripheral surface of the photosensitive drum 14 to partly remove the toner that remains on the damaged portions and to prevent the toner from scattering around.

Figure 4:
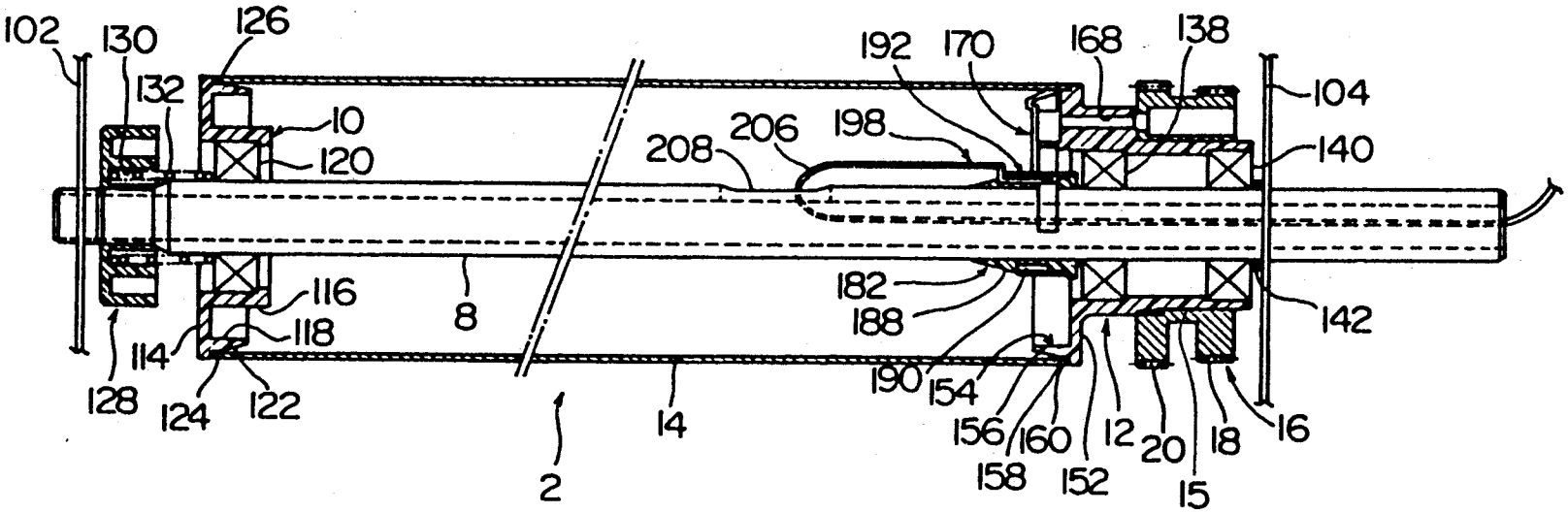
FIG. 4 is a sectional view showing a photosensitive drum body-mounting mechanism in the image-forming machine of FIG. 1.

A mechanism for mounting the photosensitive drum body 14 on the photosensitive drum 2 will now be described in detail. With reference to FIG. 4, a front upright support plate 102 and a rear upright support plate 104 are arranged in the housing (not shown) of the image-forming machine maintaining a distance in the back-and-forth direction, and the aforementioned stationary support shaft 8 that extends substantially horizontally is secured to the upright support plates 102 and 104 in a suitable manner. The aforementioned front flange member 10 and the rear flange member 12 are rotatably mounted on the support shaft 8 comprised of an elongated cylindrical member at a distance in the axial direction. The photosensitive drum body 14 is mounted to the front flange member 10 and on the rear flange member 12. The photosensitive drum body 14 is of a cylindrical shape that extends substantially horizontally and has a suitable photosensitive material fitted to the peripheral surface thereof.

The front flange member 10 may be made of a suitable synthetic resin material. The front flange member has an annular plate portion 114, and an inner cylindrical portion 116 and an outer cylindrical portion 118 that rearwardly protrude in the axial direction from the annular plate portion 114 in concentric relation therewith. A bearing member 120 is set within the inner cylindrical portion 116 that is nearly of a cylindrical shape and the front flange member 10 is rotatably mounted on the support shaft 8 via the bearing member 120. The outer cylindrical portion 118 which is nearly of a cylindrical shape has an introduction peripheral surface 122 of the shape of a circular truncated cone of which the diameter gradually decreases rearwardly and a cylindrical support peripheral surface 124 which is continuous thereto. The front flange member 10 further has an annular receiving surface 126 that outwardly extends in the radial direction from the outer edge (front edge) in the axial direction of the support peripheral surface 124. The front end of the support shaft 8 is externally threaded and a nut member 128 is fitted to the external thread. An annular holding groove 130 is formed on the inside (rear side) in the axial direction of the nut member 128, and the one end of a compression spring 132 is held in the holding groove 130. The other end of the compression spring 132 is brought into contact with the outer surface (front surface) of the bearing member 120 disposed in the front flange member 10. The compression spring 132 constitutes a resilient urging means which resiliently urges the bearing member 120 inwardly (rearwardly) in the axial direction. An annular receiving portion that inwardly protrudes in the radial direction is formed at the protruded end of the inner cylindrical portion 116 of front flange member 10, the resilient action of the compression spring 132 is transmitted to the annular receiving portion via the bearing member 120, and thus the front flange member 10 is resiliently urged inwardly (rearwardly) in the axial direction. The front end of the photosensitive drum body 14 is fitted onto the outer cylindrical portion 120 of the front flange member 10 or, more specifically onto the support peripheral surface 124 while being guided by the introduction peripheral surface 122 thereof, and its front edge is brought into contact with the annular receiving surface 126.

Therefore the resilient urging action of the compression spring 132 is transmitted to the photoconductive drum body 14 via the front flange member 10, and thus, the photoconductive drum body 14 is resiliently urged inwardly (rearwardly) in the axial direction.

Figure 5:
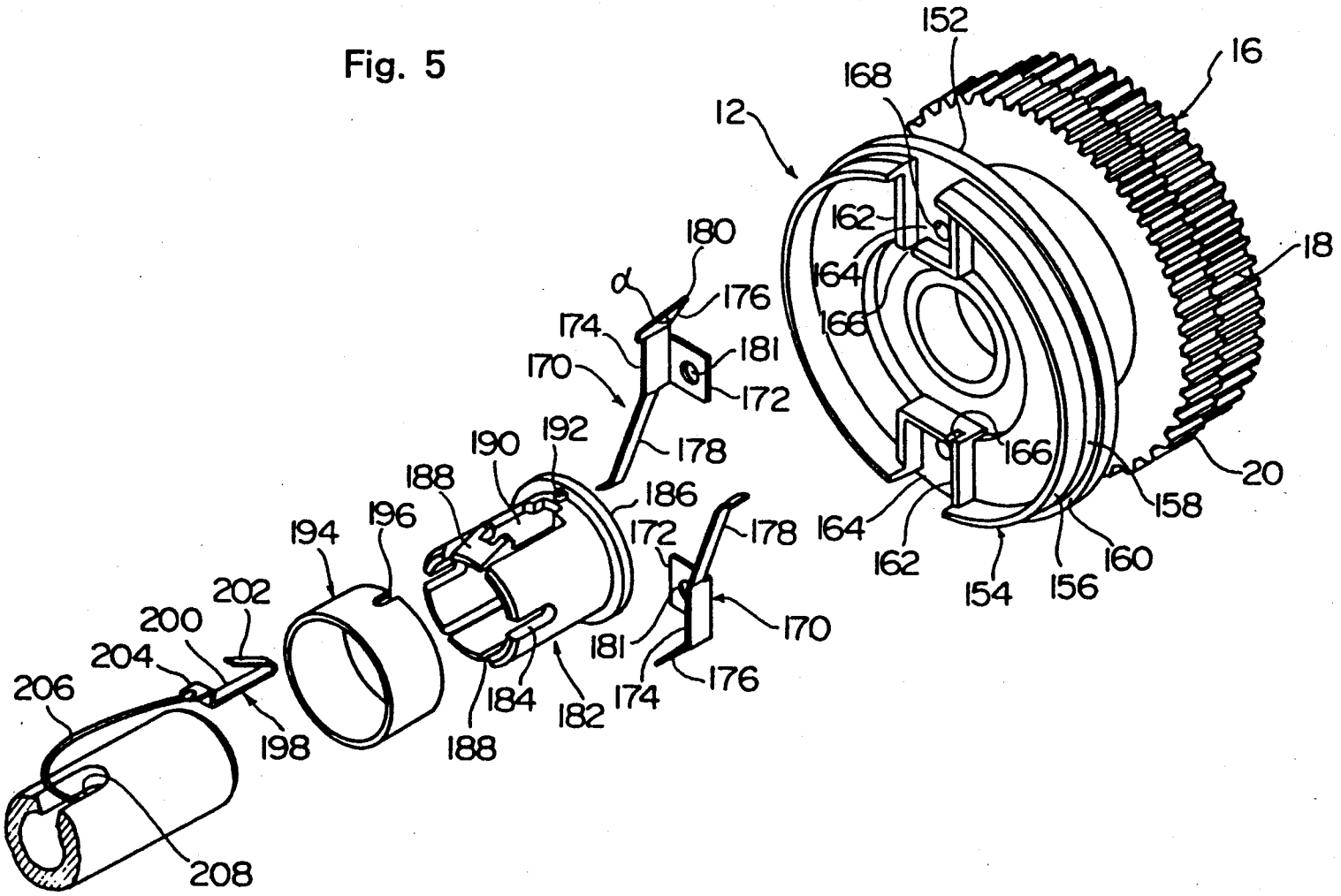
FIG. 5 is a perspective view illustrating major portions of the photosensitive drum body-mounting mechanism of FIG. 4 in a disassembled manner.
Figure 6:
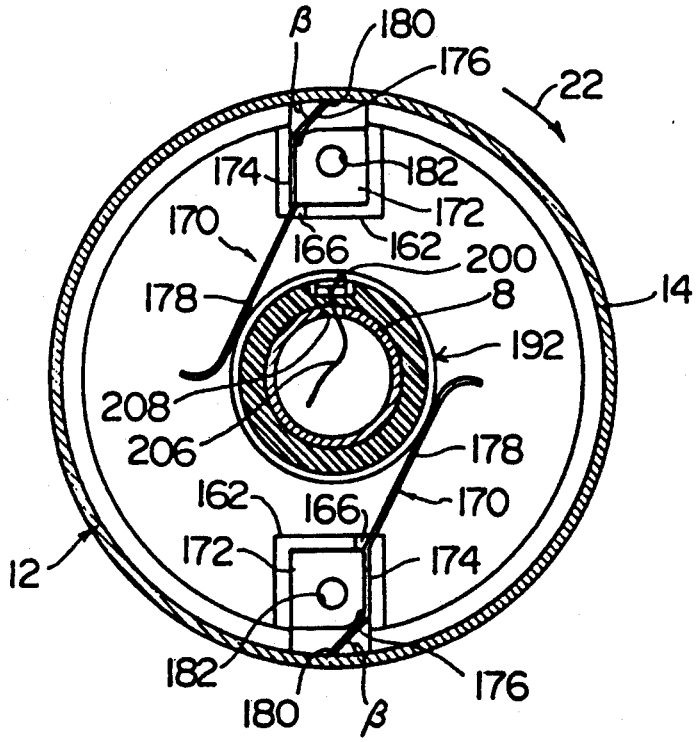
FIG. 6 is a sectional view illustrating major portions of the photosensitive drum body-mounting mechanism of FIG. 4.

With reference to FIGS. 5 and 6 together with FIG. 4, the rear flange member 12 may be also made of a suitable synthetic resin material. The rear flange member 12 has nearly a cylindrical shape as a whole. A pair of bearing members 138 and 140 are set in the rear flange member 12 at a distance in the axial direction and the rear flange member 12 is rotatably mounted on the support shaft 8 via the bearing members 138 and 140. As shown in FIG. 4 a positioning ring 142 is fitted between the rear upright support plate 104 and the bearing member 140. With the bearing member 140 that is brought into contact with the ring 142, the rear flange member 12 is limited from moving outwardly (rearwardly) in the axial direction and thus, the position of the rear flange member 12 is limited in the axial direction (i.e., the position of the photosensitive drum body 14 is limited in the axial direction). The aforementioned cylindrical protuberance 15 is formed on the rear portion of the rear flange member 12, and the gear member 16 is secured to the protuberance 15.

A disk portion 152 that outwardly extends in the radial direction is formed at the front end of the rear flange member 12, and a cylindrical portion 154 that inwardly (forwardly) protrudes in the axial direction is formed on the front surface of the disc portion 152. The cylindrical portion 154 has an introduction peripheral surface 156 of the shape of a circular truncated cone of which the diameter gradually decreases frontwardly and a cylindrical support peripheral surface 158 that is continuous thereto. The outer diameter of the support peripheral surface 158 is substantially the same as the outer diameter of support peripheral surface 124 of the front flange member 10 and is substantially the same as the internal diameter of the photosensitive drum body 14. An annular receiving surface 160 that outwardly extends in the radial direction is formed on the outside (rearwardly) in the axial direction of the support peripheral surface 158. As will be clearly understood with reference to FIG. 5, the cylindrical portion 154 is divided into two portions that are opposed to each other in the direction of diameter (i.e.. maintaining an angular distance of 180 degrees). In each of the thus divided portions a rectangular mounting region 164 is defined by a channel-shaped protruded wall 162. A notch 166 is formed on the inside portion in the radial direction of the protruded wall 162. A threaded hole 168 is formed in the mounting region 64 extending in the axial direction.

Drive coupling members 170 are secured to the two mounting regions 164 of the rear flange member 12. Each of the drive coupling members 170 is made of a suitable resilient metal or, preferably, a spring steel such as SUS 304 CSP (JIS Standard). As clearly shown in FIG. 5, the drive coupling member 170 prepared by cutting and bending a metal plate has a rectangular mounting portion 172, a central portion 174 erected from one side of the mounting portion 172, a coupling protrusion protruded toward one side from the central portion 174, and a connection protrusion 178 protruded toward the opposite side from the central portion 174. The coupling protrusion 176 is protruded in a predetermined direction with respect to the central portion 174. i.e., protruded with the tilt in a direction indicated by arrow 22 in FIG. 6. The protruding edge of the coupling protrusion 176 extends rightwardly in FIG. 4 while being tilted outwardly in the radial direction. Therefore, the tip 180 of the coupling protrusion 176 forms a sharp vertex having an acute angle $\alpha$. The connection protrusion 178, on the other hand extends in the opposite direction from the central portion 174, i.e., extends slantly in a direction opposite to the direction indicated by arrow 22 in FIG. 6, and has a tip that is bent. A hole 181 is formed in the mounting portion 172 of the drive coupling member 170, and a fastening screw (not shown) is screwed through the hole 181 into the threaded hole 168 that is formed in the mounting region 164 of rear flange member 12, to secure the drive coupling member 170 to the rear flange member 12. As will be understood with reference to FIG. 6, the tip 180 of coupling protrusion 176 of drive coupling member 170 protrudes slightly outwardly in the radial direction beyond the divided portion of cylindrical portion 154 of the rear flange member 12. The connection protrusion 178 of drive coupling member 170 extends inwardly in the radial direction through the notch 166 formed in the protruded wall 162 of rear flange member 12.

With reference to FIGS. 4 to 6 the photosensitive drum body 14 is fitted at its both ends, respectively, to the support peripheral surface 124 of the front flange member 10 and to the support peripheral surface 158 of the rear flange member 12. The compression spring 132 disposed on the front side of front flange member 10 resiliently urges the photosensitive drum body 14 rearwardly in the axial direction via the front flange member 10, whereby the rear edge of the photosensitive drum body 14 is pressed to the annular receiving surface 160 of rear flange member 12 and thus the position of the photosensitive drum body 14 is limited in the axial direction. When the photosensitive drum body 14 is mounted as desired on the front flange member 10 and the rear flange member 12, the tips of coupling protrusions 176 of drive coupling members 170 are pressed onto the inner peripheral surface of the photosensitive drum body 14 as shown in FIG. 6. On the upstream side as viewed in the direction indicated by arrow 22 in FIG. 6 i.e., as viewed in the direction in which the rear flange member 12 rotates, the coupling protrusion 176 of the drive coupling member 170 extends defining an acute angle $\beta$ with respect to the inner peripheral surface of the photosensitive drum body 14, and the tip 180 of coupling protrusion 176 forms a sharp vertex. Therefore, when the rear flange member 12 is rotated in the direction indicated by arrow 22 in FIG. 6, the tip 180 of coupling protrusion 176 of drive coupling member 170 bites into the inner peripheral surface of the photosensitive drum body 14 whereby rotation of the rear flange member 12 is reliably transmitted to the photosensitive drum body 14 (therefore, to the front flange member 10) via the drive coupling member 170, and the photosensitive drum body 14 (and the front flange member 10) are rotated in the direction indicated by arrow 22 together with the rear flange member 12. When the photosensitive drum body 14 is made of aluminum, an electrically nonconductive aluminum oxide film is, in many cases, formed on the inner peripheral surface thereof. Even in such a case, the tip 180 of coupling protrusion 176 of drive coupling member 170 bites into the electrically nonconductive oxide film to locally destroy it, and the drive coupling member 170 is inevitably electrically connected to the photosensitive drum body 14 without requiring any particular operation for removing the film. When the photosensitive drum body 14 is to be removed from the front flange member 10 and the rear flange member 12 the photosensitive drum body 14 is rotated to some extent in a direction opposite to the direction indicated by arrow 22, so that the coupling protrusion 176 of the drive coupling member 170 is very easily separated away from the inner peripheral surface of the photosensitive drum body 14.

A mounting member 182 is fitted onto the stationary support shaft 8 on the front side of the rear flange member 12 and adjacently thereto. The mounting member 182 which can be made of a suitable synthetic resin material is nearly of a cylindrical shape and has a plurality of slits 184 formed in the front side portion (left portion in FIG. 4) at intervals in the circumferential direction. A disc portion 186 that outwardly extends in the radial direction is formed at the rear end of the mounting member 182. The mounting member 182 is secured to a required position on the support shaft 8 in a suitable manner. As will be clearly understood with reference to FIGS. 4 and 5, wedge portions 188 are formed at two portions of the mounting member 182 opposing to each other in the direction of diameter (i.e., at an angular distance of 180 degrees). the wedge portions 188 protruding, while being outwardly tilted in the radial direction, toward the back in the axial direction. A recessed portion 190 is formed on the rear side of the wedge portion 188, and a protuberance 192 outwardly protruding in the radial direction is formed on the rear side of the recessed portion 190. On the mounting member 182 is mounted a cylindrical connection member 194 that can be made of a suitable electrically conductive material such as brass. Prior to fitting the mounting member 182 onto the support shaft 8, the connection member 194 is moved from the inner end of the mounting member 182 up to the recessed portion 190 in the axial direction so as to be mounted on the mounting member 182. In this mounting operation, the wedges 188 of the mounting member 182 are resiliently bent inwardly in the radial direction due to the connection member 194 and, then, resiliently restore to the original state after the connection member 194 has passed. Thus, the connection member 194 is locked on the recessed portion 190 of the mounting member 182. A notch 196 that is formed at the rear end of the connection member 194 is brought into engagement with the protuberance 192 of the mounting member 182, and the connection member 194 is prevented from rotating with respect to the mounting member 182. As shown in FIGS. 4 and 5, a connection terminal piece 198 is set between the mounting member 182 and the connection member 194. The connection terminal piece 198 which can be made of an electrically conductive resilient material such as a spring steel includes a main portion 200, a folded portion 202 that is folded from one end of the main portion 200 and then extends in the opposite direction, and a protruded portion 204 that extends outwardly in the radial direction from the other end of the main portion 200 and then extends inwardly in the axial direction. The main portion 200 and folded portion 202 of the connection terminal piece 198 are positioned on one of the recessed portions 190 of the mounting member 182, and are resiliently deformed and are held between the mounting member 182 and the connection member 194. The protruded portion 204 of the connection terminal piece 198 is protruding outwardly in the radial direction and inwardly in the axial direction beyond the mounting member 182 and the connection member 194. An end of an electric connection wire 206 is connected to the protruded portion 204. The connection wire 206 which may be an ordinary connection wire having an electrically insulating covering enters into the support shaft 8 through an opening 208 formed in the support shaft 8, runs through the inside of the support shaft 8, and goes out from the rear end thereof. The other end of the connection wire 206 is grounded via a circuit (not shown) for compensating the surface potential of the photosensitive material which has been known per se. As shown in FIGS. 4 and 6, the connection protrusions 178 of the pair of drive coupling members 170 secured to the rear flange member 12 are resiliently pressed onto the outer peripheral surface of the connection member 194 due to their own resiliency. Thus, the photosensitive drum body 14 is grounded via the drive coupling members 170, connection member 194, connection terminal piece 198 and connection wire 206.

Though the rear flange member only is provided with the drive coupling members in the illustrated embodiment, it is also allowable to provide the front flange member with similar drive coupling members. Moreover, though the rear flange member was provided with two drive coupling members, it is also possible to provide it with only one drive coupling member or with three or more drive coupling members at a distance in the circumferential direction.

In the foregoing was described a preferred embodiment of the image-forming machine constituted according to the present invention. The invention, however, is in no way limited thereto only but can be varied or modified in a variety of other ways without departing from the scope of the invention.

What I claim is:

1. A photosensitive drum body-mounting mechanism in an image-forming machine in which a cylindrical photosensitive drum body having a photosensitive material disposed on the peripheral surface thereof is detachably mounted to flange members that rotate in a predetermined direction so as to be rotated together with said flange members, wherein a drive coupling member made of a resilient metal and having a coupling protrusion is secured to said flange members, said coupling protrusion of said drive coupling member having an acute angle relative to an inner peripheral surface of said photosensitive drum body on the upstream side as viewed in the direction of rotation of said flange members and a tip of said coupling protrusion is pressed onto said inner peripheral surface of said photoconductive drum body, so that when said flange members are rotated, said tip of said coupling protrusion bites into said inner peripheral surface of said photosensitive drum body causing said photosensitive drum body and said flange members to rotate together.

2. A photosensitive drum body-mounting mechanism according to claim 1, wherein said drive coupling member is made of a spring steel.

3. A photosensitive drum body-mounting mechanism according to claim 1, wherein said tip of said coupling protrusion of said drive coupling member defines a sharp vertex.

4. A photosensitive drum body-mounting mechanism according to claim 1, wherein said photosensitive drum body is made of an electrically conductive material.

5. A photosensitive drum body-mounting mechanism according to claim 4, wherein said flange members are rotatably mounted on a stationary support shaft, a cylindrical connection member made of an electrically conductive material is fitted onto said stationary support shaft, said drive coupling member has a connection protrusion that is pressed onto the outer peripheral surface of said connection member, and said photosensitive drum body is grounded via said drive coupling member and said connection member.

6. A photosensitive drum body-mounting mechanism according to claim 1, wherein a pair of flange members are rotatably mounted on said stationary support shaft, each of said pair of flange members has a cylindrical support peripheral surface to which said photosensitive drum body is fitted and an annular receiving surface that extend outwardly in the radial direction from the outer edge in the axial direction of said support peripheral surface, said drive coupling member is secured to one of said flange members on the inside in the axial direction, the other flange member is mounted to move in the axial direction, a resilient urging means is provided to resiliently urge said other flange member inwardly in the axial direction, and said receiving surface of said other flange member is pressed onto one edge of said photosensitive drum body by the resiliently urging action of said resilient urging means and the other edge of said photosensitive drum body is pressed onto said receiving surface of said one flange member.

* * * * *